US008422724B2

(12) United States Patent
Corynen

(10) Patent No.: US 8,422,724 B2
(45) Date of Patent: Apr. 16, 2013

(54) LOUDSPEAKER WITH A STIFFENING ELEMENT

(75) Inventor: David Corynen, Brakel (BE)

(73) Assignee: PSS Belgium N.V., Dendermonde (BE)

( * ) Notice: Subject to any disclaimer, the term of this patent is extended or adjusted under 35 U.S.C. 154(b) by 638 days.

(21) Appl. No.: 12/598,757

(22) PCT Filed: May 2, 2008

(86) PCT No.: PCT/IB2008/001389

§ 371 (c)(1),
(2), (4) Date: Mar. 25, 2010

(87) PCT Pub. No.: WO2008/135857

PCT Pub. Date: Nov. 13, 2008

(65) Prior Publication Data

US 2010/0183187 A1 Jul. 22, 2010

(30) Foreign Application Priority Data

May 3, 2007 (GB) ..... 0708593.9

(51) Int. Cl.
*H04R 25/00* (2006.01)

(52) U.S. Cl.
USPC ..... 381/398; 381/423; 381/424

(58) Field of Classification Search ..... 381/396, 381/398, 403, 404, 405, 412, 416, 423, 424; 181/157, 164, 165, 171, 173
See application file for complete search history.

(56) References Cited

U.S. PATENT DOCUMENTS

| | | | | |
|---|---|---|---|---|
| 6,236,733 | B1 * | 5/2001 | Kato et al. | 381/423 |
| 7,236,607 | B2 * | 6/2007 | D'Hoogh | 381/396 |
| 7,599,511 | B2 * | 10/2009 | Corynen | 381/423 |
| 2006/0088184 | A1 | 4/2006 | Ohashi et al. | |

FOREIGN PATENT DOCUMENTS

| | | | |
|---|---|---|---|
| EP | 1646264 | A2 | 4/2006 |
| GB | 0323264 | A | 6/1929 |
| JP | 57190499 | A | 5/1981 |
| JP | 60171899 | A | 9/1985 |
| WO | 2005/020630 | A | 3/2005 |
| WO | 2005/117490 | A | 12/2005 |

* cited by examiner

*Primary Examiner* — Huyen D Le
(74) *Attorney, Agent, or Firm* — Peter A. Nieves; Sheehan Phinney Bass + Green PA

(57) ABSTRACT

The present invention provides: a loudspeaker including a frame, a drive unit, and a membrane;

the membrane having an inner edge, an outer edge which is suspended from the frame, and a membrane body which is between the inner and outer edges and extends around the drive unit;

the drive unit having a stationary part secured to the frame and a translatable part secured to the inner edge of the membrane;

the membrane body including a dished portion which, has a depth that increases from said inner and outer edges towards a base region of the dished portion located between said edges;

wherein the loudspeaker includes a stiffening element which extends around the drive unit and stiffens the membrane body at the base region of the dished portion, so as to reinforce the membrane against deformation in the base region. By including the stiffening element, it has been found that the first break-up resonance of the membrane is shifted to a higher frequency and has reduced amplitude. As a consequence, the loudspeaker according to this aspect has a more balanced frequency response, particularly at mid and high frequency ranges.

13 Claims, 8 Drawing Sheets

LOUDSPEAKER WITH A STIFFENING ELEMENT

The present application claims the benefit under 35 U.S.C. 0371 of International Application No.: PCT/IB2008/001389 (published PCT application No. WO2008/135857 A1), filed May 2, 2008, which claims priority to GB Application Serial No.: 0708593.9 filed May 3, 2007; the entire contents of each of the above-referenced applications are incorporated herein by reference.

This invention relates to loudspeakers including a frame, a membrane and a drive unit. In particular, this invention relates to woofers and full-range loudspeakers.

Loudspeakers having a frame, a conical membrane and a drive unit are generally known for the reproduction of sound. The conical membrane has an inner circular edge and an outer circular edge with a conical body therebetween. In use, the drive unit causes the conical membrane (which acts as a piston) to move backwards and forwards to generate pressure waves, i.e. sound. The conical membranes of these loudspeakers must have at least a minimum stiffness in order to move as a piston for low frequency sound reproduction, and to have controlled behaviour at and above the frequency of the first cone-break up of the membrane for mid and high frequency sound reproduction. In order to achieve this minimum stiffness, the conical membrane must have at least a minimum height.

It is also known to have a loudspeaker membrane that is not conical. For example, different shaped membranes may be used in order to provide a loudspeaker with a smaller height than an equivalent conventional loudspeaker with a conical membrane.

PCT Application Publication Number WO2005/015950 discloses a loudspeaker which has membrane with a flat inner edge, a flat outer edge and a plurality of radial folds in a membrane body therebetween. The radial folds are present to give the membrane additional stiffness.

However, although a loudspeaker membrane that is not conical may be desirable for reducing the height of a loudspeaker, there can be a deterioration in the sound reproduction of a loudspeaker when a non-conical membrane is used.

According to one aspect of the invention, there may be provided a loudspeaker according to claim 1.

By including the stiffening element, it has been found that the first break-up resonance of the membrane is shifted to a higher frequency and has reduced amplitude. As a consequence, the loudspeaker according to this aspect has a more balanced frequency response, particularly at mid and high frequency ranges. It is thought that the amplitude of the first break-up resonance is reduced because of a reduction in deformation of the membrane body at said base region of the dished portion. The "base region" of the dished portion refers to the deepest part of the dished portion, i.e. the part having maximum depth relative to the edges of the membrane. The base region may be planar (e.g. a flat face at the maximum depth). The base region may be linear (e.g. an edge which is at the maximum depth).

The stiffening element extends completely around the drive unit, i.e. the whole way around the drive unit and without interruption. Therefore, the stiffening element may be circular (e.g. ring shaped), elliptical, or have any other suitable shape. Therefore, the stiffening element is simple to produce, thus saving on cost and effort.

The stiffening element preferably reinforces the base region against all deformation of the base region from its rest shape (i.e. from the shape of the base region when the loudspeaker is not in use).

In particular, the stiffening element preferably reinforces the base region against circumferential deformation, in other words, deformation relative to a path extending around the drive unit. Circumferential deformation may include flexing of the base region such that the base region moves inwardly and outwardly relative to the edges of the membrane (i.e. towards and away from the drive unit). Circumferential deformation may also include flexing of the base region such that the depth of the base region relative to the edges of the membrane varies along a path extending around the drive unit, e.g. movement of the base region relative to the edges of the membrane in the direction of movement of the drive unit.

Preferably, the stiffening element substantially prevents deformation in the base region. However, when the loudspeaker is in use, the stiffening member may allow the membrane body to bend in the base region to a certain degree, in order to accommodate movement of the membrane caused by the translatable part of the drive unit. Therefore, when it is indicated that the stiffening element reinforces against "deformation" in the base region, it is intended to mean that the stiffening element reinforces against deformation beyond that which is necessary to accommodate movement of the translatable part of the drive unit. In some arrangements, it may not be necessary for the base region to deform to accommodate movement of the drive unit (for example, if the outer edge of the membrane is suspended from the frame by a roll-collar which allows whole body movement of the membrane).

The stiffening of the base region by the stiffening element should be substantial, in other words, the stiffening should significantly affect the resonant behaviour of the membrane. Thus, the stiffening element is differentiated from suspension means (e.g. spiders) which are known in the art for centering the voice coil in the magnet systems of loudspeakers but which do not significantly affect the resonant behaviour of the membrane.

By "dished portion", it is meant that the membrane body includes a portion which is dished when viewed in cross-section, i.e. when viewed in a direction substantially perpendicular to the membrane body. The depth of the dished portion may increase smoothly towards said base region from the inner and outer edges of the membrane. The dished portion may be "v" shaped. It may have sloping sides, which may be substantially flat, or may be curved.

The dished portion may extend (completely) around the drive unit (e.g. as shown in FIG. 1*b*), but the membrane body should not be seen as being limited in this way. For example, the membrane body may include a plurality of dished portions. The plurality of dished portions may be arranged around the drive unit (e.g. as shown in FIGS. 4*b* and 5*b*). The plurality of dished portions may be arranged to have their base regions located on a path extending around the drive unit, e.g. on a path corresponding to the shape of the stiffening element. The stiffening element may stiffen the base region(s) of one, some or all of the dished portions. Preferably, the stiffening element stiffens all the base regions.

The edges of the membrane may be circular, or substantially circular. The base region may be circular. If there are a plurality of dished portions, the base regions may be circumferential, i.e. extending along or located on a circular path around the drive unit. The stiffening element may have a shape which corresponds to the shape of the base region(s), for example, the stiffening element may be circular.

The stiffening element may have a shape which provides additional stiffness at said base region of the dished portion. Therefore, the stiffening element may, when viewed in cross-section, include a corrugation. The stiffening element preferably has only one corrugation for simplicity, but may include more than one corrugation. Alternatively, the stiffening element may have a "U" shape when viewed in cross section. In other words, it may have substantially parallel sides joined with a flat or rounded base.

Preferably, the membrane body and stiffening element are made from materials which are light weight and high in stiffness. Because the stiffening element is not part of the membrane, i.e. it is a discrete element, the material of the stiffening element can be selected independently of the material of the membrane. For example, the material of the membrane could be selected for acoustic reasons, and the material of the stiffening element could be selected for its stiffness. The stiffening element and the membrane may be of the same material.

The stiffening element and/or the membrane may be of any material with low density and high stiffness. Suitable materials include paper (which may be reinforced paper), aluminium, titanium, polypropylene, polycarbonate, acrylonitrile butadiene styrene or Kevlar™ (para-aramid synthetic fiber).

The stiffening element is preferably located at the base region, in other words, in close proximity to the base region.

The stiffening element may be located on the outwardly dished (e.g. convex) side of the dished portion of the membrane body. Alternatively, the stiffening element may be located on the inwardly dished (e.g. concave) side of the dished portion of the membrane body. Preferably, the stiffening element is located on the outwardly dished side of the dished portion so that the stiffening element does not alter the shape of the sound generating surface of the membrane, since locating the stiffening element on the inwardly dished side of the dished portion may have a negative impact on the mid and high frequency sound reproduction of the membrane.

The stiffening element is preferably attached to the base region of the dished portion. This attachment may be direct, i.e. so that the stiffening element is in contact with the base region of the dished portion. However, the stiffening element may also be attached to the base region via a secondary element (e.g. via a suspension means as discussed below) provided it stiffens the base region so as to reinforce against deformation. Suitably, the stiffening element may be attached to the membrane body, directly or indirectly, by adhesive.

The stiffening element may include one or more flat faces suitable for applying adhesive thereto (e.g. for attachment to the base region) There may be two flat faces, which may be located either side of the corrugation in the stiffening element.

The loudspeaker may further include suspension means attached to the frame and to the base region of the dished portion. The suspension means may extend completely around the drive unit. The suspension means may attach to the frame at an outer part of the frame, i.e. a part of the frame which is located outwardly of the base region. Alternatively, the suspension means may attach to the frame at an inner part of the frame, i.e. a part of the frame which is located inwardly of the base region. The suspension means may attach to an outer part of the frame, an inner part of the frame and the base region (e.g. to keep dust out of the drive unit). There may be more than one suspension means. In one arrangement there may be a first suspension means which attaches to the frame at an outer part of the frame and a second suspension means which attaches to the frame at an inner part of the frame (e.g. to keep dust out of the drive unit).

The suspension means may be a spider which is known. Spiders are textile rings (e.g. cotton or Nomex™) which join the frame to the membrane so as to allow movement only in the direction of movement of the translatable part of the drive unit. Spiders are known for centering the voice coil in the magnet systems of loudspeakers.

The stiffening element of the present aspect should be differentiated from known suspension means such as spiders. In particular, spiders do not significantly stiffen the base region so as to reinforce against deformation of the base region of the dished portion. Therefore, spiders do not have a significant effect on the resonant behavior of the membrane. In contrast to a spider, the stiffening element preferably does not join the membrane to the frame. In contrast to a spider, the stiffening element preferably is not flexible in the direction of movement of the translatable part of the drive unit.

The suspension means may be attached to the base region of the dished portion directly, or via a secondary element. Thus, the suspension means may be attached to the base region of the dished portion via the stiffening element. Alternatively, the suspension means may be attached directly to the base region, with the stiffening element attached directly to the suspension means, i.e. so that the stiffening element is attached to the base region of the dished portion via the suspension means. Alternatively, the stiffening element and suspension means may both attach to the base region of the dished portion directly. Adhesive may be used to provide the attachment between the stiffening element, the suspension means and/or the base region of the dished portion.

As explained above, the base region may be a flat face in the dished portion of the membrane body. This is advantageous a flat face is particularly suitable for attachment by adhesive.

The membrane body may have a plurality of folds therein, e.g. to increase the stiffness of the membrane body. The folds may have any suitable shape (e.g. they may be rounded folds or sharp folds). The folds may be radial folds, i.e. they may extend outwardly from the inner edge of the membrane. The folds may be arranged to include one of the plural dished portions described above. Examples of membrane bodies including folds and plural dished portions are shown in PCT publication number WO 2005/015950 which is incorporated herein by reference.

The inner and outer edges of the membrane are preferably substantially flat. This helps during production of the loudspeaker, since it is easier to secure flat membrane edges to the frame and translatable part of the drive unit (e.g. by methods generally known for, mounting flat membranes). "Substantially flat" is intended to mean flat with deviations that are small compared with the depth of the dished portion. The inner and outer edges may be coplanar with each other, i.e. located in the same plane.

The outer edge of the membrane may be suspended from the frame by a roll-collar. The roll-collar may be of rubber, foam or textile. The roll-collar is preferably flexible so as to allow whole body movement of the membrane.

In addition to the first membrane break-up, the loudspeaker will have a "piston resonance" which is a resonance associated with the whole body movement ("piston mode") of the membrane. The frequency of the piston resonance depends on various parameters including the mass of the membrane and the manner in which the membrane is connected to the frame (e.g. the stiffness of the spider if a spider is present). Preferably, these parameters are selected such that the resonant frequency is much lower than that of the first membrane break-up.

In another aspect of the invention, there is provided a membrane and a stiffening element as described above. There may also be provided a membrane, a stiffening element and a suspension means as described above.

Embodiments of our proposals are discussed below, with reference to the accompanying drawings in which:

FIG. 1*a* is a cross-sectional view of a first loudspeaker.

FIG. 1*b* is a perspective view of the first loudspeaker shown in FIG. 1*a*.

FIG. 2*a* is a graph of electrical impedance against frequency for the first loudspeaker with and without a stiffening element.

FIG. 2*b* is a graph of sound pressure level against frequency for the first loudspeaker with and without a stiffening element.

FIG. 3 is a cross sectional view showing deformation of the membrane of the first loudspeaker when there is no stiffening element.

FIG. 4*a* is a cross-sectional view of a second loudspeaker.

FIG. 4*b* is a perspective view of the second loudspeaker shown in FIG. 4*a*.

FIG. 5*a* is a cross-sectional view of a third loudspeaker.

FIG. 5*b* is a perspective view of the third loudspeaker shown in FIG. 5*a*.

Figure 1A:
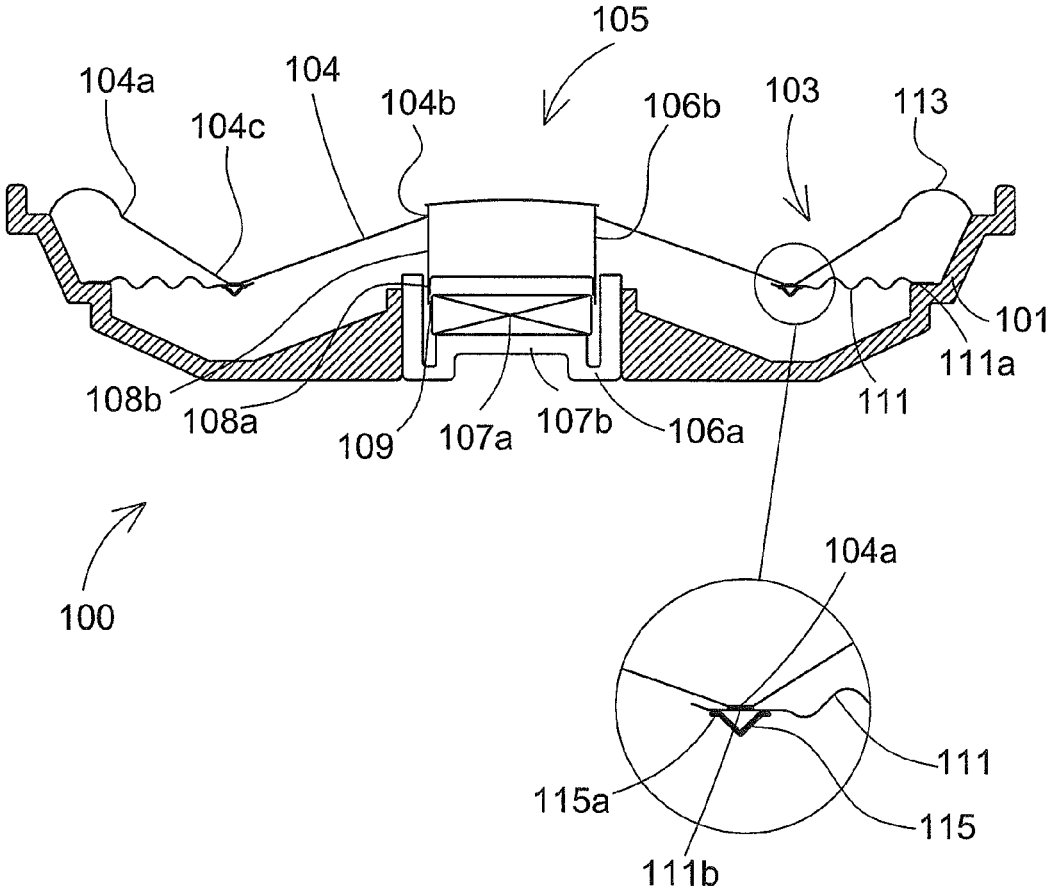
Figure 1B:
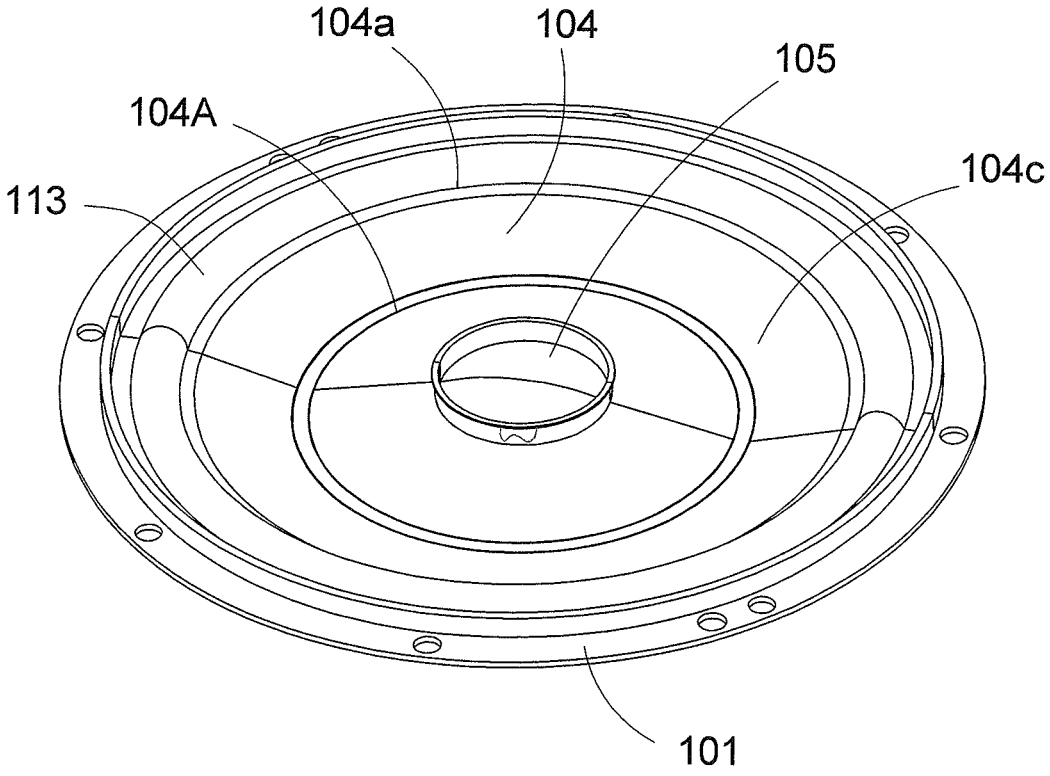

FIGS. 1*a* and 1*b* show a first loudspeaker 100. The loudspeaker 100 includes a frame 101, a membrane 103 and an electromagnetic drive unit 105.

The membrane 103 includes an outer circular edge 104*a*, an inner circular edge 104*b* and a membrane body 104 therebetween. The membrane body 104 has an axis-symmetric v-cone shape. In other words, when viewed in cross-section, i.e. in a direction substantially perpendicular to the membrane (e.g. as shown in FIG. 1*a*) the membrane body 104 forms a dished portion 104*c*, having sloping walls which form a "v" shape. The dished portion 104*c* extends completely around the drive unit 105. The depth of the dished portion 104*c* increases smoothly from the outer and inner edges 104*a*, 104*b* towards a base region which is a face 104A located between the edges 104*a*, 104*b*. Thus, the face 104A is at the deepest part of the dished portion 104*c*. In this embodiment, the face 104A is flat, but this need not be the case. The membrane 103 is made of paper, e.g. reinforced paper.

The drive unit 105 has a stationary part 106*a*, and a movable, i.e. translatable, part 106*b*. The stationary part 106*a* is secured to the frame 101 and has a magnet system including a permanent magnet 107*a* and a magnetic yoke 107*b*. The translatable part 106*b* has a coil system including a voice coil 108*a* and a coil former or support 108*b* on which the coil 108*a* is attached. The magnetic system and the coil system magnetically cooperate, i.e. magnetically interact, with each other during use through an air gap 109.

The inner edge 104*b* of the membrane 103 is adhered to the coil support 108*b* by glue, which may be any suitable glue.

The outer edge 104*a* of the membrane 103 is secured to the frame 101 by a resilient means 113 which, in this embodiment, is a roll-collar made of rubber, foam or textile.

The membrane body 104 is also connected to the frame 101 by a suspension means, in this case a spider 111 having an outer rim 111*a* and an inner rim 111*b*. The spider 111 is secured to an outer part of the frame 101 at its outer rim 111*a* and to the face 104A of the membrane body 104 at its inner rim 111*b*, preferably by glue. The spider 111 is flexible in the direction of motion of the movable part 106*b* of the drive unit but rigid in a direction perpendicular to this. Therefore the spider 111 centres the membrane 103 and consequently centres the voice coil 108*a* in the air gap 109.

A circular stiffening element 115 is attached to the membrane face 104A. In this embodiment, the stiffening element 115 is attached to the membrane face 104A indirectly, via the inner rim 111*b* of the spider 111. However, it should be understood that the stiffening element 115, the spider 111 and the membrane face 104A can be layered in any order. The spider 111 may be omitted from the loudspeaker 100. Nonetheless, whether the stiffening element 115 is attached to the membrane face 104A directly or indirectly, it should be attached in such a way that the membrane body 104 is stiffened at the membrane face 104A.

Viewed in cross-section, the stiffening element 115 includes a corrugation which is "v" shaped with flat faces 115*a* at each side of the corrugation. The stiffening element is attached to the outer rim 111*b* of the spider 111 at the flat edges 115*a* by any suitable attachment means, e.g. glue.

The stiffening element 115 is made of reinforced paper, but may be made from any material with combined low density and high stiffness, such as paper, aluminium, titanium, polypropylene, polycarbonate, acrylonitrile butadiene styrene or Kevlar™.

Figure 2A:
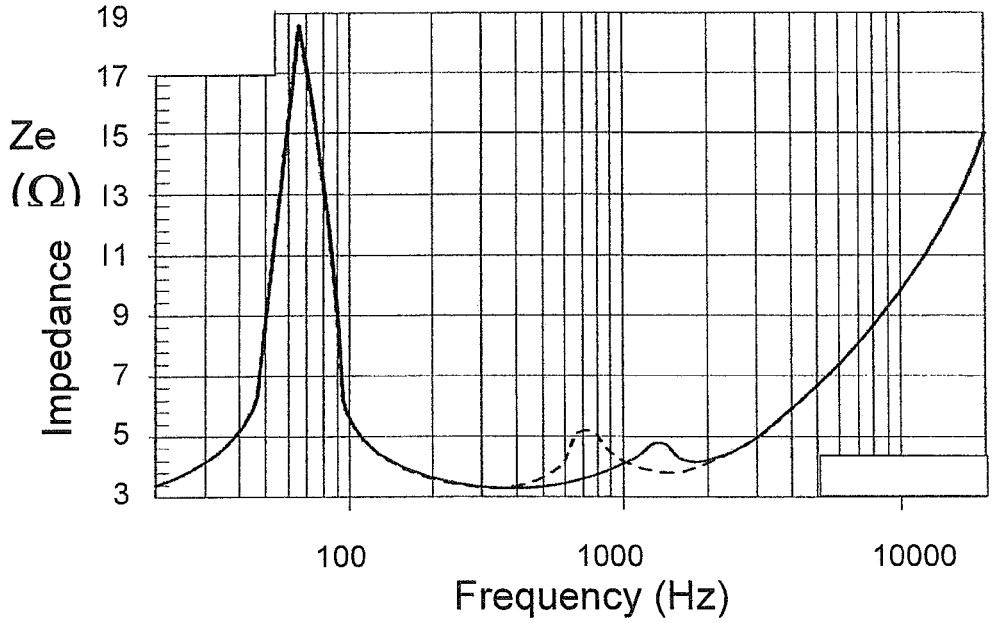
Figure 2B:
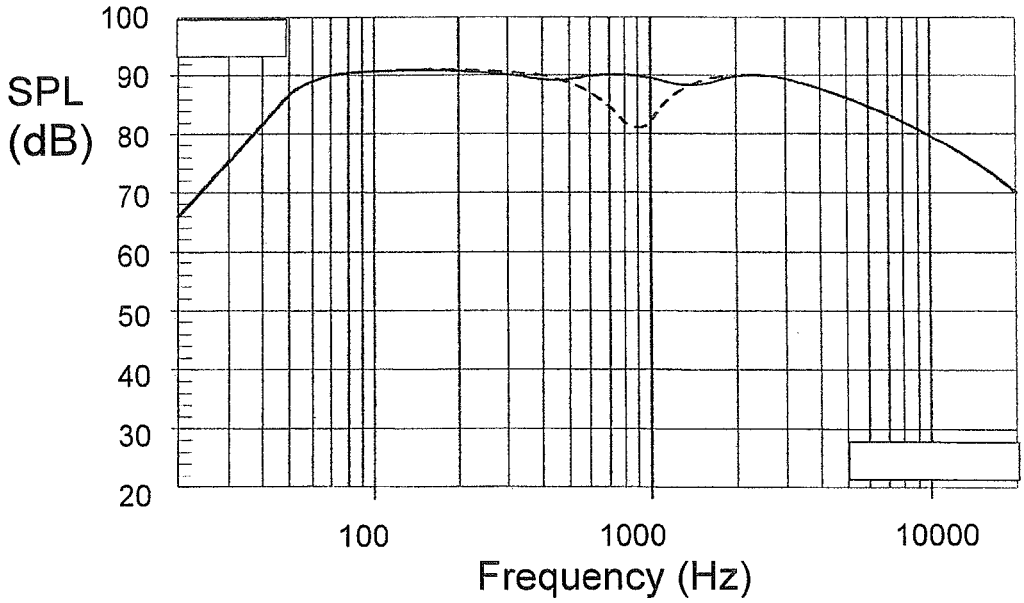
Figure 3:
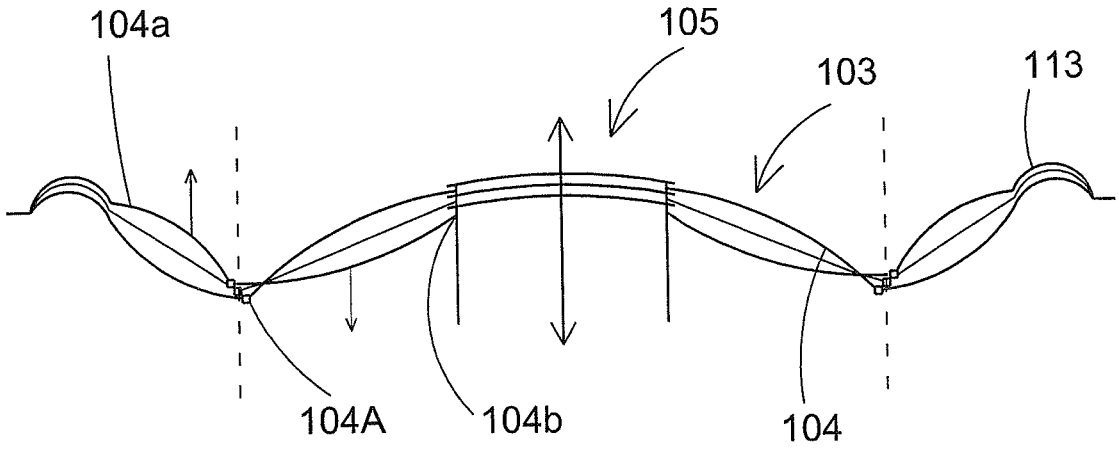

The function of the stiffening element 115 can be understood with reference to FIGS. 2*a*, 2*b* and 3.

FIGS. 2*a* and 2*b* respectively show graphs comparing electrical impedance (Ze) and sound pressure level (SPL) against frequency. The solid lines indicate the measurements taken for the loudspeaker 100 shown in FIGS. 1*a* and 1*b*. The dashed lines indicate the measurements taken for the loudspeaker 100 shown in FIGS. 1*a* and 1*b* when the stiffening element 115 is removed.

Because the approximate relationship between the mechanical impedance (Zm) and electrical impedance (Ze) is Zm~1/Ze, FIG. 2*a* allows observation of resonances in the loudspeaker 100. A resonance is observed when the electrical impedance is high, since this corresponds to a low mechanical impedance.

FIG. 2*a* shows that there is a severe resonance at the first membrane break-up at approximately 700 Hz for the loudspeaker 100 without the stiffening element 115 (illustrated by the dashed line). It is thought the severe resonance is assisted by excessive deformation of the membrane 103 at the membrane face 104A. The severe resonance in the membrane 103 without the stiffening element 115 is illustrated by FIG. 3. As can be seen from FIG. 3, there is substantial deformation of the membrane body 104 at the face 104A. In particular, the membrane face 104A is distorted to move inwards and outwards relative to the edges 104*a*, 104*b* (i.e. towards and away from the drive unit 105), and upwards and downwards relative to the edges 104*a*, 104*b*. (i.e. in the direction of motion of the translatable part 106*b* of the drive unit 105). The severe resonance causes a degradation in the performance of the loudspeaker 100, resulting in a reduction in sound pressure level at around the frequency of the severe resonance (see FIG. 2*b*).

When the stiffening element 115 is attached to the membrane face 104A as shown in FIG. 1*a*, the resonance from the first membrane break-up moves to a higher frequency and is reduced in amplitude (see the solid line in FIG. 2*a*). As a result, a balanced frequency response is obtained (see FIG. 2*b*). In other words there is little reduction in sound pressure level due to the first membrane break-up when the stiffening element 115 is used. It is thought that the balanced frequency response is achieved, in part at least, by the stiffening element 115 reducing circumferential deformation of the membrane 103 at the face 104A.

FIGS. 2*a* and 2*b* also illustrate that the spider 111 provide insufficient stiffening to the face 104A since both measurements (solid line and dashed line) are made with the spider 111 attached. In other words, the spider 111 does not provide enough stiffness against deformation of the face 104A since there is not a balanced frequency response when the spider 111 is in place without the stiffening element 115.

Figure 4A:
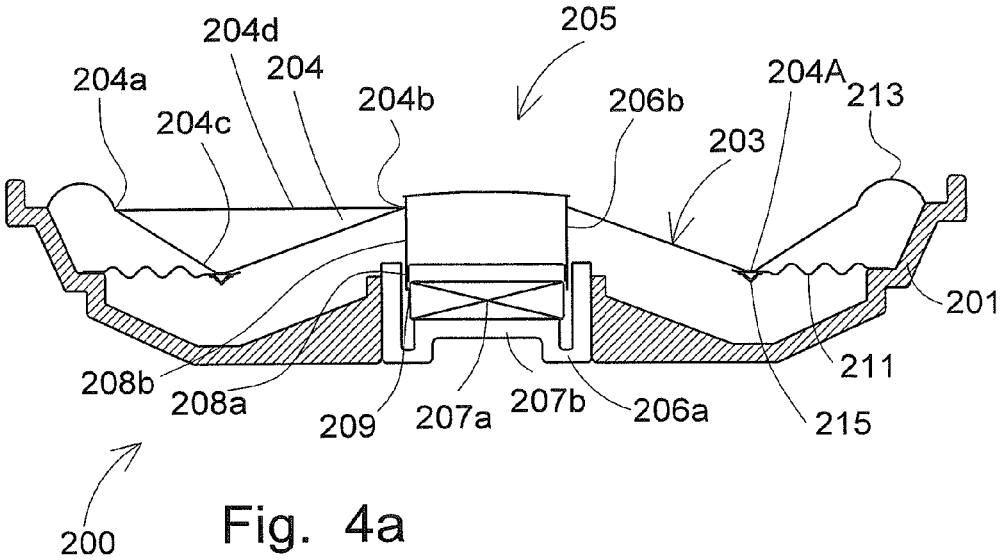
Figure 4B:
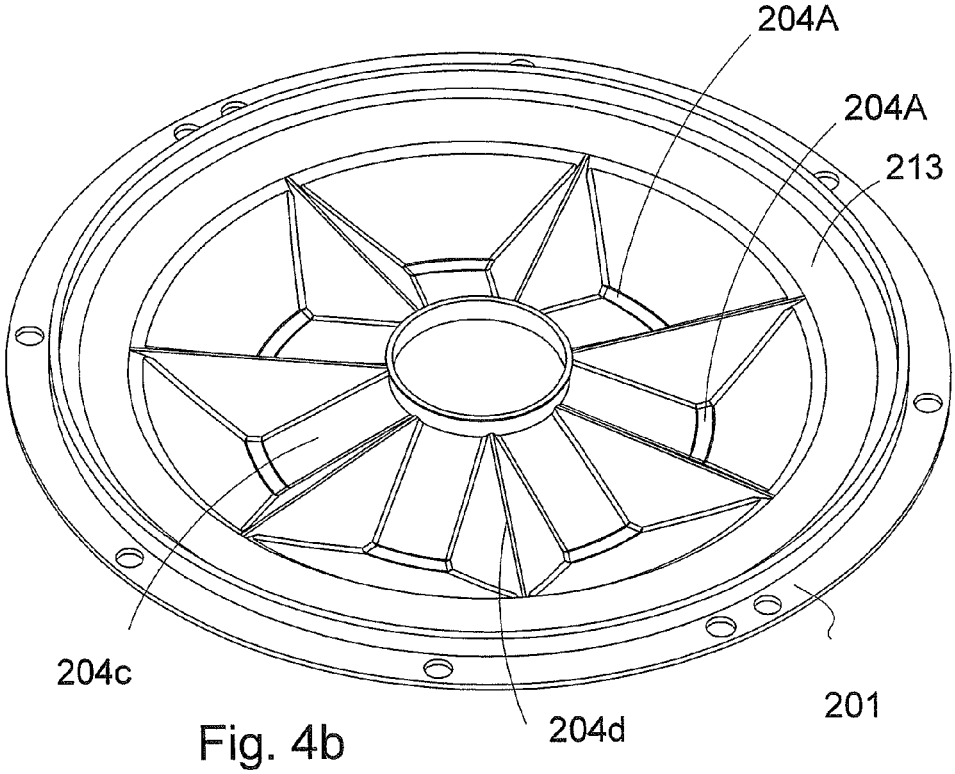

FIGS. 4*a* and 4*b* show a second loudspeaker 200. The second loudspeaker 200 has many of the features of the first loudspeaker 100. For ease of reference, the reference signs used in FIGS. 4*a* and 4*b* correspond to the reference signs used in FIGS. 1*a* and 1*b*.

In the loudspeaker 200, the membrane 203 is shaped differently to the membrane 203 of the loudspeaker 103. In particular, the membrane body 204 includes a pattern of plural radial folds in the surface thereof which are located between ridges 204*d*. The ridges 204*d* are level with, and extend between, the outer and inner edges 204*a*, 204*b* of the membrane body 204. The radial folds increase the stiffness of the membrane body 204.

In between ridges 204*d*, the membrane body 204 includes plural dished portions 204*c*. Each dished portion 204*c* has a face 204A at its deepest part. A stiffening element 215 is attached to all of the faces 204A via the spider 211, in order to stiffen the membrane body 204 at each of the faces 204A. The stiffening element 215 reduces deformation in the membrane body 204 at faces 204A in a similar manner to the first loudspeaker 100.

Figure 5A:
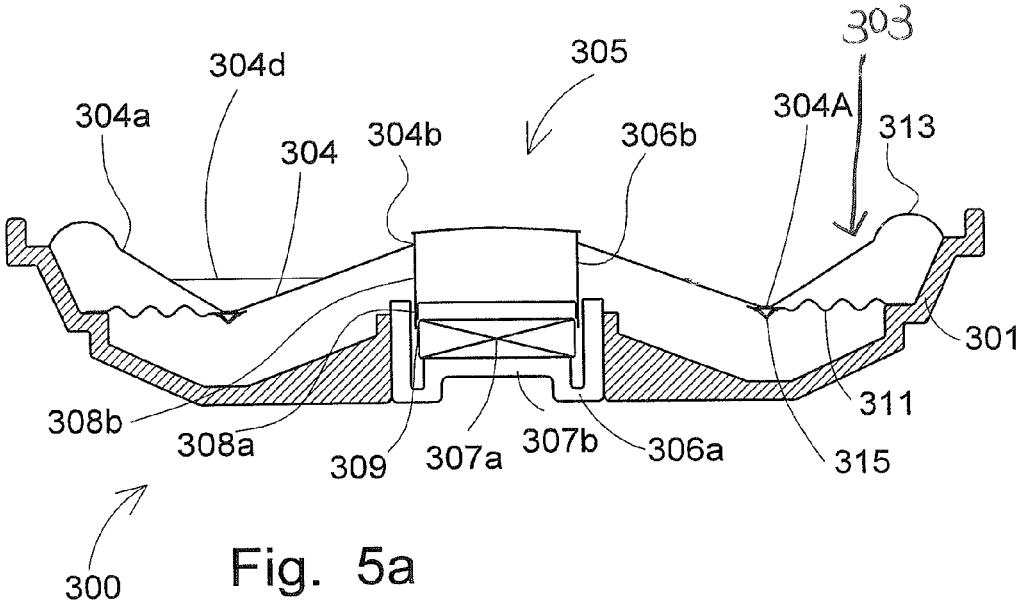
Figure 5B:
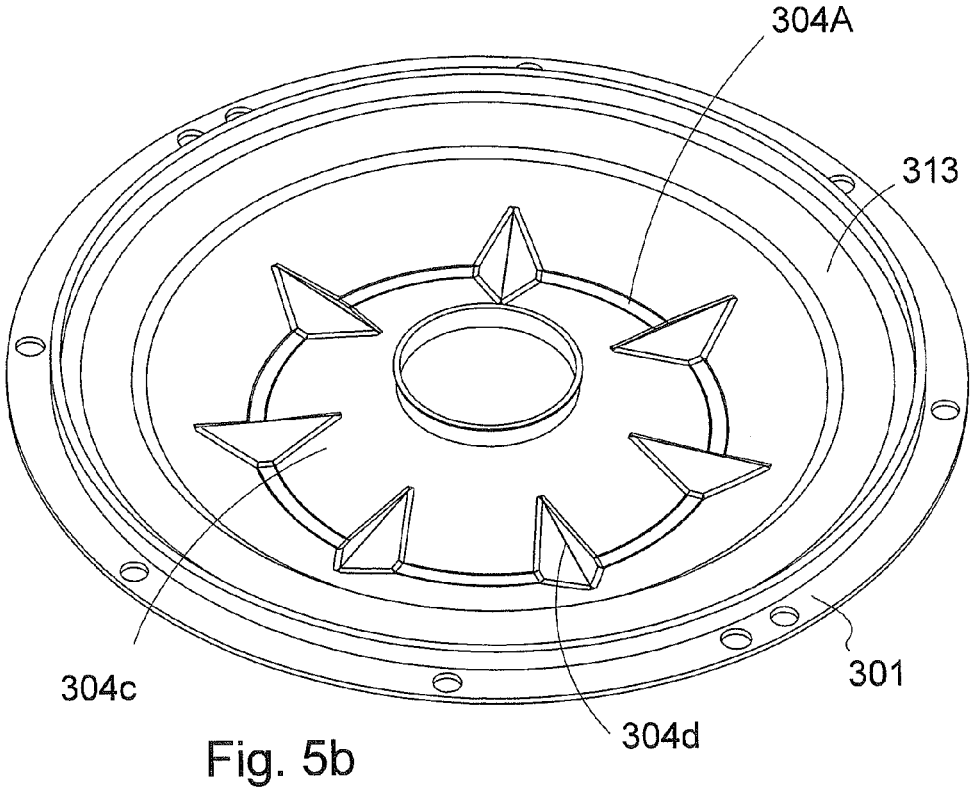

FIGS. 5*a* and 5*b* show a third loudspeaker 300. The third loudspeaker 300 has many of the features of the first and second loudspeakers 100, 200. For ease of reference, the reference signs used in FIGS. 5*a* and 5*b* correspond to the reference signs used in FIGS. 1*a* and 1*b*.

The membrane body 304 includes a pattern of plural radial folds in the surface thereof which are located between ridges 304*d*. Unlike in the second loudspeaker 200, the ridges 304*d* extend across only a portion of the sloping walls of the membrane body 304. The radial folds increase the stiffness of the membrane body 304.

In between ridges 304*d*, the membrane body 304 includes plural dished portions 304*c*. Each dished portion 304*c* has a face 304A at its deepest part. The stiffening element 315 is attached to all of the faces 304A via the spider 311, in order to stiffen the membrane body 304 at each of the faces 304A. The stiffening element 315 reduces deformation in the membrane body 304 at faces 304A in a similar manner to the first and second loudspeakers 100, 200.

Figure 6:
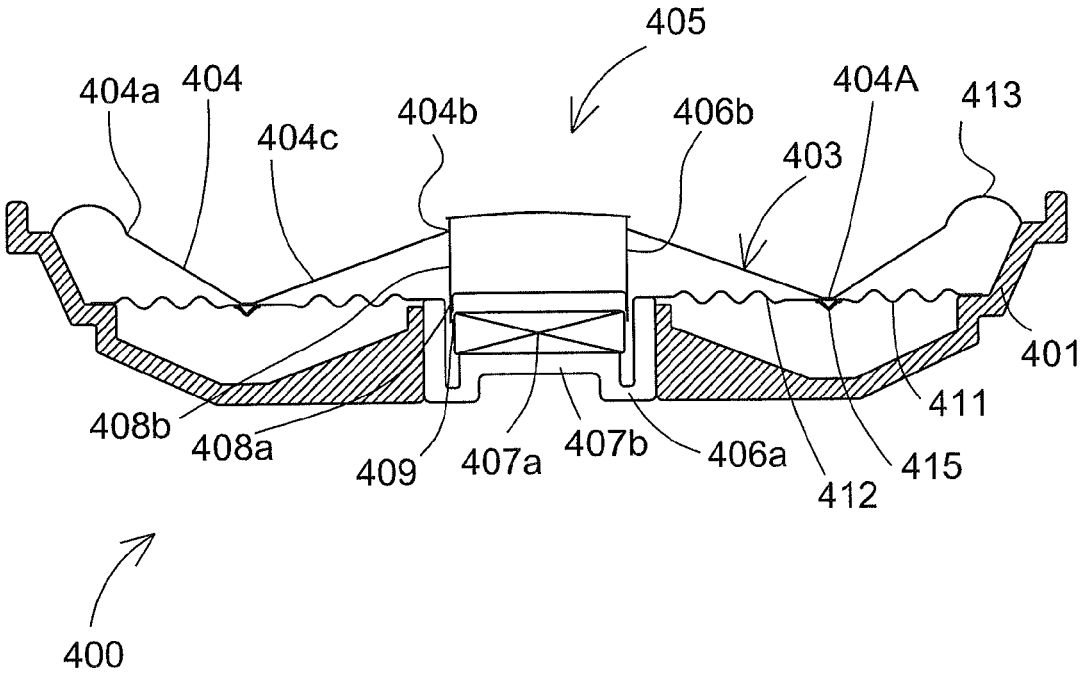
FIG. 6 is a cross-sectional view of a fourth loudspeaker.

FIG. 6 shows a fourth loudspeaker 400. The fourth loudspeaker 400 has many of the features of the first, second and third loudspeakers 100, 200, 300. For ease of reference, the reference signs used in FIG. 6 correspond to the reference signs used in FIGS. 1*a* and 1*b*.

Unlike in the first loudspeaker 100, the fourth loudspeaker 400 has two spiders 411, 412. A first spider 411 attaches to an outer part of the frame 401 and face 404A in the same way as in the first loudspeaker. A second spider 412 is attached to an outer part of the frame 401 and the face 404A. This double spider arrangement is particularly advantageous as it helps to keep dust out of the drive unit 405 as well as centering the voice coil 408*a*. This advantage need not be achieved by using two spiders. For example, the same advantage could also be achieved by a single spider which attaches to an outer part of the frame, an inner part of the frame and the face 404A.

Figure 7:
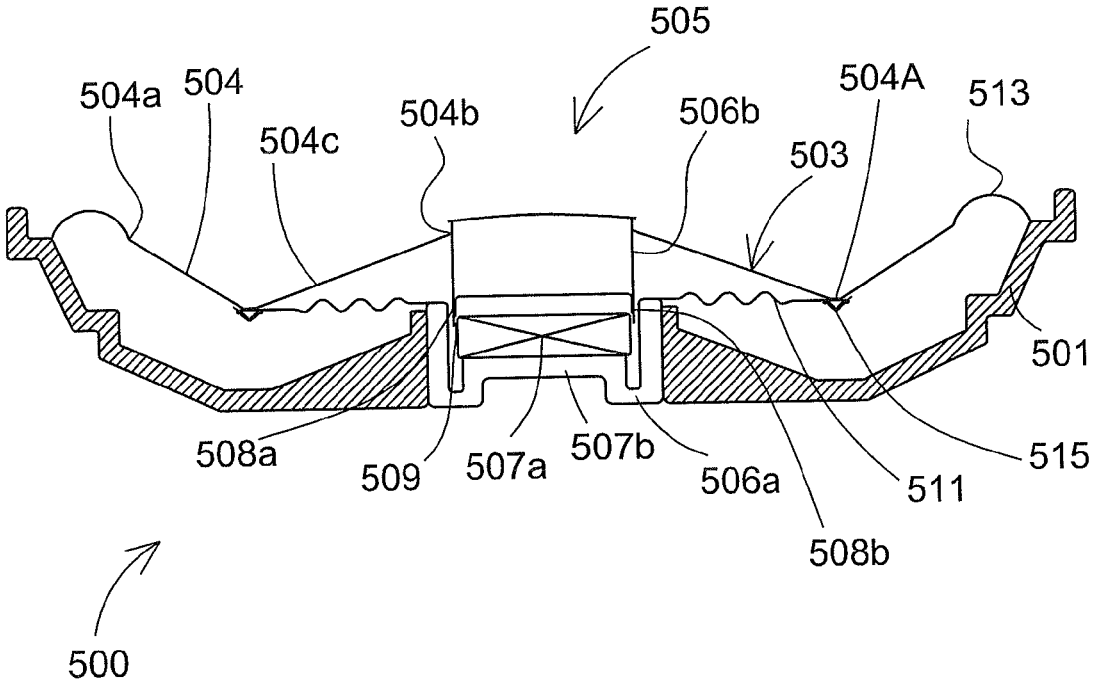
FIG. 7 is a cross-sectional view of a fifth loudspeaker.

FIG. 7 shows a fifth loudspeaker 500. The fifth loudspeaker 500 has many of the features of the first, second, third and fourth loudspeakers 100, 200, 300, 400. For ease of reference, the reference signs used in FIG. 6 correspond to the reference signs used in FIGS. 1*a* and 1*b*.

Unlike in the first loudspeaker 100, in the fifth loudspeaker 500, the spider 511 attaches to an inner part of the frame 501 and the face 504A of the membrane 504.

In addition to the embodiments shown in the drawings, a stiffening element 115, 215, 315, 415, 515 as shown in any of the drawings may also be used with any of the loudspeaker membranes shown and described in PCT publication number WO2005/015950.

One of ordinary skill after reading the foregoing description will be able to affect various changes, alterations, and subtractions of equivalents without departing from the broad concepts disclosed. It is therefore intended that the scope of the patent granted hereon be limited only by the appended claims, as interpreted with reference to the description and drawings, and not by limitation of the embodiments described herein.

The invention claimed is:

1. A loudspeaker including a frame, a drive unit, and a membrane;

the membrane having an inner edge, an outer edge which is suspended from the frame, and a membrane body which is between the inner and outer edges and extends around the drive unit;

the drive unit having a stationary part secured to the frame and a translatable part secured to the inner edge of the membrane;

the membrane body including a dished portion which, has a depth that increases from said inner and outer edges towards a base region of the dished portion located between said edges, wherein the base region of the dished portion is a face in the membrane body located at the deepest part of the dished portion;

wherein the loudspeaker includes a circular stiffening element which extends around the drive unit, wherein the circular stiffening element is located on the outwardly dished side of the dished portion of the membrane body and is attached to the membrane body at the base region of the dished portion, thereby stiffening the membrane body at the base region of the dished portion, so as to reinforce the membrane against deformation in the base region;

wherein the stiffening element, when viewed in cross-section, includes a "v" shaped corrugation with flat faces at each side of the corrugation.

2. A loudspeaker according to claim 1 wherein the stiffening element is made from a material selected from paper, aluminium, titanium, polypropylene, polycarbonate, acrylonitrile butadiene styrene or para-aramid synthetic fiber.

3. A loudspeaker according to claim 1 wherein the stiffening element is attached directly to the base region of the dished portion.

4. A loudspeaker according to claim 1 further including a suspension means which is attached to the frame and to the base region of the dished portion.

5. A loudspeaker according to claim 4 wherein the suspension means is attached directly to the base region of the dished portion.

6. A loudspeaker according to claim 5 wherein the stiffening element is attached directly to the suspension means, so that the stiffening element is attached to the base region of the dished portion via the suspension means.

7. A loudspeaker according to claim 1 wherein the face in the membrane body located at the deepest part of the dished portion is a flat face in the membrane body.

8. A loudspeaker according to claim 1 wherein the depth of the dished portion of the membrane body increases smoothly towards the base region from the inner and outer edges of the membrane.

9. A loudspeaker according to claim 1 wherein the dished portion extends around the drive unit.

10. A loudspeaker according to claim 1 wherein the membrane body includes a plurality of dished portions.

11. A loudspeaker according to claim 10 wherein the membrane body has a plurality of folds.

12. A loudspeaker according to claim 11 wherein the folds are radial folds.

13. A loudspeaker element according to claim 1 wherein the inner and outer edges of the membrane are circular.

* * * * *